United States Patent [19]

Bänninger

[11] Patent Number: 4,617,980

[45] Date of Patent: Oct. 21, 1986

[54] CATERPILLAR TYPE MOLD HAVING MOLD LINKS WITH CHAMFERED EDGES

[75] Inventor: Urs Bänninger, Wollerau, Switzerland

[73] Assignee: Swiss Aluminium Ltd., Chippis, Switzerland

[21] Appl. No.: 741,691

[22] Filed: Jun. 6, 1985

[30] Foreign Application Priority Data

Jun. 15, 1984 [CH] Switzerland ..... 2906/84

[51] Int. Cl.[4] ..... B22D 11/06

[52] U.S. Cl. ..... 164/430; 164/479

[58] Field of Search ..... 164/431, 430, 479

[56] References Cited

U.S. PATENT DOCUMENTS

| | | | |
|---|---|---|---|
| 1,139,888 | 5/1915 | Mellen | 164/430 X |
| 1,342,127 | 6/1920 | Mellen | 164/430 X |
| 3,342,251 | 9/1967 | Nagin et al. | 164/430 |
| 3,502,136 | 3/1970 | Parmelee et al. | 164/430 |
| 3,955,615 | 5/1976 | Dompas et al. | 164/431 |

*Primary Examiner*—Nicholas P. Godici

*Assistant Examiner*—J. Reed Batten, Jr.

*Attorney, Agent, or Firm*—Bachman & LaPointe

[57] ABSTRACT

A machine for continuously casting metal features a caterpillar type mold with a mold link which bears a plate forming the actual mold workface. At least one of the long edges of this plate is chamfered towards the mold workface. As a result thermal expansion occurring during operation of the machine is taken into account so that the work face of the mold is not deformed.

6 Claims, 2 Drawing Figures

CATERPILLAR TYPE MOLD HAVING MOLD LINKS WITH CHAMFERED EDGES

BACKGROUND OF THE INVENTION

The invention relates to a mold link of a caterpillar type mold for a machine for continuous casting metal, in which the said mold link features a plate forming the actual work face of the mold.

Such casting machines are presently finding increasing use for the continuous casting of aluminum and steel strips; they are, however, also useable for casting other metals. The molten metal is conducted via a trough into a tundish, and from there passed through a nozzle into the mold gap between two caterpillar type molds. These caterpillar type molds, described in simplified terms, comprise an upper and lower belt on which a plurality of block-like mold links are arranged. In the actual region of the mold gap these mold links lie close together; in the curved regions on the other hand they lie wide open. Provided with the mold gap are cooling facilities, in particular facilities for cooling the mold work face. In the mold gap this work face reaches a temperature of approximately 400° C. and, before it re-enters the mold gap, is cooled again to about 80°–100° C. It is easy to appreciate that such temperature changes over short distances result in very high thermal stressing of the mold work face or of the plate bearing that work face. It is in fact subjected to thermal deformation in all directions.

Bowing of the plate has been countered so far e.g. by mounting the plate on a clamping facility which supports in particular the very highly stressed parts of the plate. The plate, however, expands also in the mold gap as it is heated to about 400° C. with the result that there two plates, which from the start lie very close together in order to produce a high quality surface, press hard against each other with increasing force. The consequence is that the touching longitudinal edges yield at the work face and are pushed up forming a jagged profile facing in towards the mold gap. This deformation is then transferred to the surface of the cast strip, thus deminishing the quality of that surface.

The object of the present invention is to develop a mold link of the kind mentioned above but such that the work face of the mold does not deform, and thus corresponding flaws on the surface of the cast strip are avoided.

SUMMARY OF THE INVENTION

This object is achieved by way of the invention in which the mold link of the above mentioned kind has at least one of the longitudinal edges of the plate chamfered towards the work face of the mold.

This simple measure of providing a chamfered sloping edge or edges has the effect that as the, usually copper, work plate expands, its edges can yield without producing projections which transfer to the strip being cast.

The depth of the chamfer is preferably about 5/100 mm.

BRIEF DESCRIPTION OF THE DRAWINGS

Further advantages and details of the invention are revealed in the following description of a preferred exemplified embodiment shown schematically in the drawings viz.

DETAILED DESCRIPTION

Figure 1:
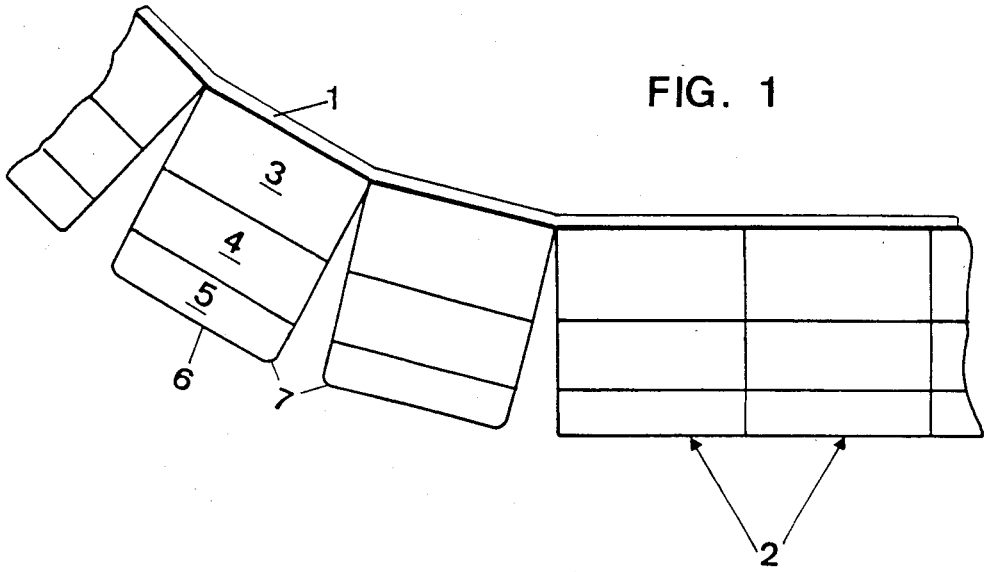
FIG. 1 is a part of a side elevation of a caterpillar type mold strand.

A strip caster for continuous casting metal, for reasons of simplification not shown here, features a caterpillar type mold with two facing belts 1. In FIG. 1 one such belts 1 with mold links 2 attached thereto is shown.

Figure 2:
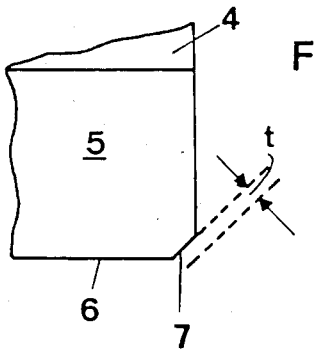
FIG. 2 is a perspective view of a mold link.

Such a mold link 2 is suspended from the belt 1 via a support block 3. Releasably attached to the support block is a clamping device 4 which is made up of individual segments that are not shown here; the said clamping device 4 counters thermal distortion of a plate 5 the surface of which forms the actual work face 6 of the mold. Both long edges 7 of this plate 5 are, as shown in FIG. 1, chamfered towards the mold work face 6. In the enlarged view shown in FIG. 2 it can be seen that the long edge 7, on one or both sides of the plate 5, is chamfered to a depth t of about 5/100 mm. The chamfering extends over the whole length of the plate.

What is claimed is:

1. A caterpillar type mold for a casting machine for continuously casting metal strip which comprises a belt, a plurality of mold links attached to said belt, each of said mold links comprising a plate forming a work face of the mold, said plate having edges thereof adjacent said work face, wherein at least one of the said edges of the plate is a chamfered edge towards the mold work face that can expand when heated to provide a work face without projections between adjacent mold links which transfer to the cast strip and thereby produce a cast strip surface without flaws.

2. The caterpillar type mold according to claim 1 wherein the depth of the chamfer from the plane of the work face is about 5/100 mm.

3. The caterpillar type mold according to claim 1 wherein two edges are chamfered.

4. The caterpillar type mold according to claim 1 further including a support block connecting each of said mold links to the belt.

5. The caterpillar type mold according to claim 4 further including a clamping device attached to the support block.

6. The caterpillar type mold according to claim 5 wherein the chamfer extends over the entire length of the plate.

* * * * *